United States Patent [19]

Pflieger et al.

[11] 4,131,151

[45] Dec. 26, 1978

[54] REACTIVE GASEOUS COOLING MEDIUM FOR THE MANUFACTURE OF WIRE

[75] Inventors: Bernard Pflieger, Chamalieres; Philippe Sauvage; Francis Tombrel, both of Clermont-Ferrand, all of France

[73] Assignee: Compagnie Generale des Etablissements Michelin, Clermont-Ferrand, France

[21] Appl. No.: 842,896

[22] Filed: Oct. 17, 1977

[30] Foreign Application Priority Data

Oct. 15, 1976 [FR] France ..... 76 31803

[51] Int. Cl.[2] ..... B22D 11/00

[52] U.S. Cl. ..... 164/89; 164/423

[58] Field of Search ..... 164/64, 66, 82, 89, 164/259, 415, 418, 423, 443, 444; 264/176 F

[56] References Cited

U.S. PATENT DOCUMENTS

| | | | |
|---|---|---|---|
| 3,788,786 | 1/1974 | Dobo | 164/259 |
| 3,861,452 | 1/1975 | Massoubre | 164/89 |
| 3,946,794 | 3/1976 | Rakestraw | 164/82 |

*Primary Examiner*—Richard B. Lazarus
*Assistant Examiner*—K. Y. Lin
*Attorney, Agent, or Firm*—Brumbaugh, Graves, Donohue & Raymond

[57] ABSTRACT

A reactive cooling medium for apparatus for the manufacture of wire by projecting a jet of liquid steel which contains silicon and manganese through a nozzle into a cooling enclosure containing the reactive cooling medium is characterized by the fact that the reactive cooling medium is a gaseous mixture having an oxidizing power with respect to the steel, at least in the zone adjacent to the orifice of the nozzle, such that the oxidation product of the steel is silica at the thermochemical equilibrium corresponding to the temperature prevailing near the orifice of the nozzle.

11 Claims, 4 Drawing Figures

REACTIVE GASEOUS COOLING MEDIUM FOR THE MANUFACTURE OF WIRE

This invention relates to improvements in processes and apparatus for the manufacture of wire by projecting a jet of liquid steel into a reactive gaseous cooling medium. More particularly, it relates to improvements in the process of U.S. Pat. No. 3,861,452 and an apparatus employing that process. In that process a jet of liquid steel is projected whose silicon content is such that, in the possible presence of manganese, the first oxidation product which is formed in the reactive cooling medium is silica ($SiO_2$), the composition of the reactive cooling medium being such that it has sufficient oxidizing power with respect to the jet of liquid steel to form a stabilizing film of silica around the jet, permitting the transformation of the liquid jet into continuous solid wire.

Apparatus employing that process comprise a crucible containing the liquid steel and provided with at least one nozzle, means for exerting pressure on the liquid steel sufficient to project it in the form of a jet through the nozzle into the reactive cooling medium, and a cooling enclosure containing the reactive cooling medium within which the liquid jet is transformed into solid wire.

When using the operating conditions stipulated in that patent without employing special precautions, damage to the nozzles which is incompatible with profitable industrial use is noted in certain cases.

This damage appears on the wall of the orifice of the nozzle on the cooling enclosure side and brings about a change in the geometrical characteristics of the wire; at the outlet of the orifice of the nozzle a relatively large deposit of a vitreous appearance can be noted. This deposit contains oxides and silicates of iron and manganese.

This damage is attributable to the fact that particles of metal which have been detached from the jet and the boundary limits remain in the cooling medium near the orifice of the nozzle for a sufficient period of time for their oxidation to lead to the formation of compounds (oxides and/or silicates) which are more corrosive with respect to the materials constituting the nozzle than silica is at the temperature near the orifice of the nozzle.

FIG. 1 shows schematically a Si, Mn, O equilibrium diagram of a liquid steel containing silicon and manganese at a temperature T. The abscissa axis represents the increasing contents of silicon (%Si) in the steel and the ordinate axis represents the increasing contents of manganese (%Mn). The abscissa axis and the equilibrium curve 3 define the region 1 of the formation of silica ($SiO_2$), while the ordinate axis and the curve 3 define the region 2 of the formation of manganese silicate. If a particle of this steel having silicon and manganese contents corresponding to the point $A_1$ in the region 1 is immersed into an oxidizing medium, it becomes covered with silica. This point $A_1$, which is representative of the composition of the surface coating, as it becomes impoverished in silicon and enriched in silica moves along a line parallel to the abscissa axis up to the point B located on the equilibrium curve 3. From point B on, if the oxidizing medium still permits oxidation, manganese silicate appears. The reaction can proceed to a state of equilibrium corresponding to the oxidation potential available in the oxidizing medium at the temperature in question, the composition of the metal of the particles becoming more or less simultaneously poorer in silicon and in manganese.

On the jet itself, on the other hand, which passes in a few hundredths of a second from the liquid state at about 1500° C. to the solid state at ambient temperature, the oxidation is very rapidly blocked and, at this level, the equilibrium states are never reached.

In order to avoid deterioration of the orifice of the nozzle, it has been proposed (U.S. Pat. Nos. 3,645,657 and 3,788,786 and 3,613,158) that the cooling enclosure be divided into two consecutive parts. The first part, which is next to the nozzle, contains an inert gas which is without an oxidizing element, while the second part, which follows the first part, contains a cooling medium which is provided with an oxidizing element. In this way, the formation of oxidation products is suppressed in the part of the jet which is next to the nozzle.

This arrangement, however, has drawbacks. Under certain operating conditions, deterioration of the orifice of the divergent nozzle is still noted, although traces of vitreous deposit adhering to the outlet face and the walls of the orifice have disappeared. In order to avoid any retrodiffusion of the oxidizing gases from the second part of the cooling enclosure towards the first part, which is to contain a completely inert gas, very precise and therefore costly structural elements are necessary. Furthermore, an increase in the frequency of breaks of the wire is noted.

In order to increase the life of the nozzles, within the scope of the manufacture of wires by solidification of a liquid jet of steel containing silicon and manganese, the present invention consists in controlling and limiting the oxidizing power of the reactive cooling medium, at least in the zone adjacent to the orifice of the nozzle, so as to prevent the formation of iron and manganese oxides and/or silicates at the thermochemical equilibrium corresponding to the temperature prevailing near the orifice of the nozzle and permit the formation of silica alone.

The present description is given with reference to the drawing, which illustrates non-limitative embodiments of the invention. In the drawing.

Figure 1:
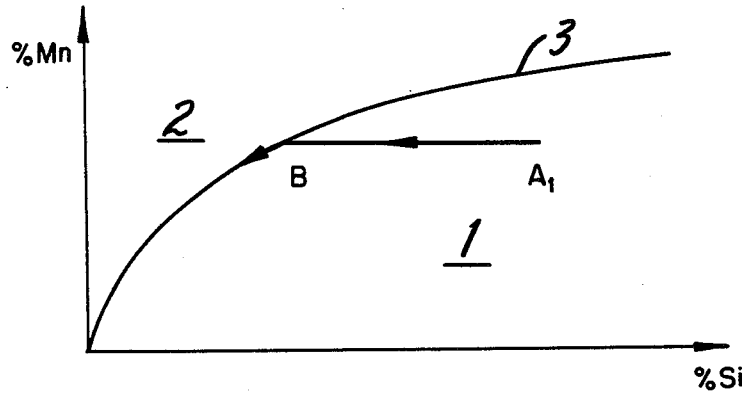
FIG. 1 (as noted above) shows schematically a Si, Mn, O equilibrium diagram of a steel.
Figure 3:
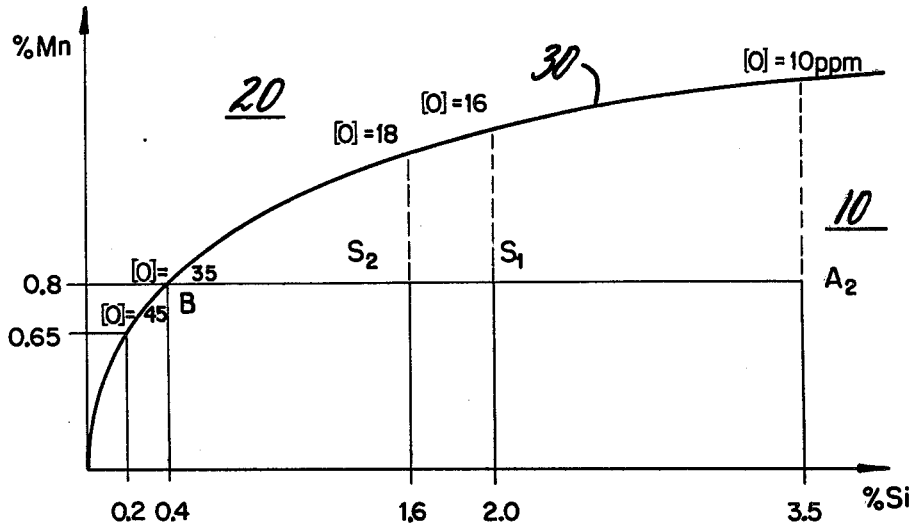
Figure 4:
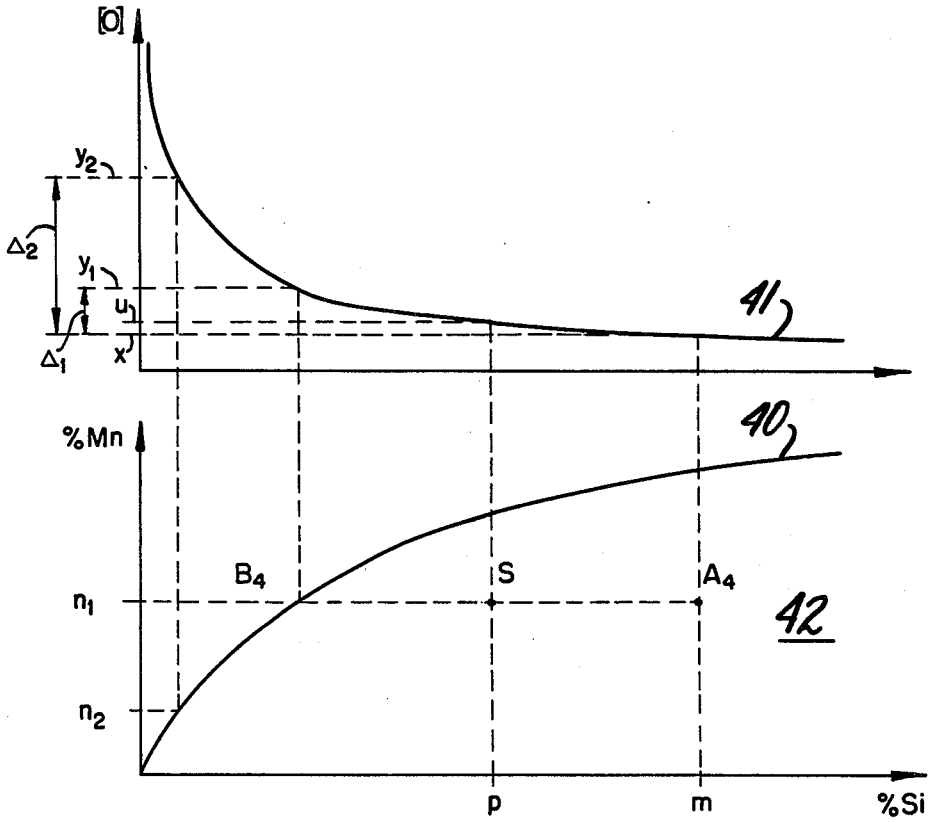

FIG. 3 shows a Si, Mn, O equilibrium diagram of a steel, similar to that of FIG. 1, and mentions the oxygen contents dissolved in the steel entered on the curve which marks off the region of formation of the silica from the region of the formation of the silicates; and FIG. 4 shows a Si, Mn, O equilibrium diagram of a steel, similar to those of FIGS. 1 and 3, juxtaposed on a diagram showing the contents of dissolved oxygen, the two diagrams referring to the same silicon contents.

Within the scope of the present invention, the oxidizing power of the reactive cooling medium may be defined in the following manner.

A thermochemical state of equilibrium is established at a temperature T between a cooling medium having a given oxidizing power and a liquid steel of given composition. At this state of equilibrium, the steel contains a certain amount of dissolved oxygen [O], whose activity $A_o$ can be measured by means of a suitable electrochemical cell. (A. Svensson, An Oxygen Activity Measuring System For Molten Steel, in The Institute of Measurement and Control, Sheffield, October 19–20, 1972).

The oxidizing power of a cooling medium with respect to a steel of a given composition and at a temperature T can be defined by the content of oxygen dissolved in the steel at the thermochemical equilibrium by the cooling medium. Moreover the oxidation of the steel increases with the oxidizing power of the cooling medium, and vice versa.

A reactive cooling medium in accordance with the invention, having a controlled oxidizing power with respect to a liquid steel of given initial composition at a temperature T, can be produced by mixing, in well-defined proportions, an inert gas (nitrogen, argon, helium) and/or a reducing gas (hydrogen) with a gas which is an oxidant with respect to the steel (carbon monoxide, carbon dioxide, steam, oxygen).

A reactive cooling medium formed, for instance, of a mixture of helium (He) and carbon monoxide (CO) acts schematically in the following manner on a particle of liquid steel at 1500° C. containing initially 0.4% carbon (C), 3.5% silicon (Si), and 0.8% manganese (Mn).

For a sufficient partial pressure of CO ($P_{co}$) in the cooling medium, silica ($SiO_2$) appears on this particle. The composition of the latter changes in accordance with the oxidizing power of the cooling medium in such a manner that the chemical equilibria $$Si + 2O \rightleftarrows SiO_2 \text{ and } C + O \rightleftarrows CO$$

are satisfied.

Table I below indicates approximately the values of the silicon content, the partial pressure of the carbon monoxide and the content of dissolved oxygen corresponding to different stages of the oxidation.

Table I

| % Si | $P_{co}$ (atmosphere) | [O] (ppm) |
|---|---|---|
| 3.5 | 0.13 | 10 |
| 2 | 0.33 | 16 |
| 1.6 | 0.50 | 18 |

Thus, for a CO partial pressure equal to 0.13 atmosphere, such a cooling medium has an oxidizing power with respect to the steel which is defined by a content of 10 ppm of oxygen dissolved in the steel.

On an Si, Mn, O equilibrium diagram (FIG. 3) in the same liquid steel at 1500° C., similar to the equilibrium diagram of FIG. 1, $A_2$ is the point representing the equilibrium for a content of oxygen [O] equal to 10 ppm. In FIG. 3, the equal oxidizing power curve 30 separates the region 10 of formation of silica from the region 20 of formation of silicates.

In accordance with Table I, by increasing the oxidizing power of the reactive cooling medium by increase of the partial pressure $P_{co}$ to 0.33 atmosphere, the oxidizing power is defined by a content of oxygen [O] which increases to 16 ppm; the point representing this new state of equilibrium is $S_1$ (% Si = 2). A part of the silicon has reacted with the oxygen, and the layer of silica on the particle has increased in thickness. Likewise, the oxidizing power of this reactive cooling medium having a CO partial pressure equal to 0.5 atmosphere is defined by a content of dissolved oxygen equal to 18 ppm, $S_2$ being the point representing this equilibrium. The amount of silica formed on the particle has further increased to the detriment of the silicon content of the steel.

With a reactive cooling medium whose oxidizing power is higher than the above values, the representative point of the composition of the steel may reach the point B on curve 30, from which point B manganese silicate appears. The chemical equilibria $$Si + 2O \rightleftarrows SiO_2 \text{ and } Mn + O \rightleftarrows MnO$$

are satisfied for the following values corresponding to the point B:

$$\% Mn = 0.8, \% Si = 0.4, [O] = 35 \text{ ppm}.$$

35 ppm is then the oxygen content which defines the critical value of the oxidizing power, beyond which manganese silicate appears at the orifice of the nozzle.

Beyond the values corresponding to the point B, the oxidation can continue by the deposition of manganese silicate on the particle of steel to the detriment of both the manganese and silicon contents of the steel. Thus, for an oxidizing power of the reactive cooling medium which is defined by an oxygen content in the steel of 45 ppm, at equilibrium, the silicon content of the steel drops to 0.2% and the manganese content to 0.65%.

FIG. 4, on the one hand, shows diagrammatically a curve 40 of equal deoxidizing power, similar to curves 3 and 30 of FIGS. 1 and 3, for silicon and manganese. Furthermore, FIG. 4 shows the corresponding curve 41 of the content of oxygen dissolved in the steel as a function of the silicon content of the steel.

A particle of steel having initial contents m% of silicon and $n_1$% of manganese, represented by the point $A_4$ located in the region 42 of the formation of silica, which is subjected to the action of an reactive cooling medium, first of all becomes covered with silica, for example up to an equilibrium corresponding to the point S (p% of silicon and $n_1$% of manganese in the steel) for an oxidizing power of the reactive cooling medium defined by a content u of dissolved oxygen.

For an initial manganese content equal to $n_1$, the critical oxidizing power corresponding to the point $B_4$ located on the equal deoxidizing power curve 40 is defined by the critical oxygen content $y_1$.

For such an initial composition (m% Si, $n_1$ % Mn) of the steel, one can vary the oxidizing power of the reactive cooling medium in accordance with the invention between the two limits defined by the initial content x and the critical content $y_1$ of dissolved oxygen. One, therefore, has an adjustment range of width $\Delta_1$ for the reactive cooling medium in accordance with the invention. FIG. 4 also shows that this adjustment range can be widened and that one can thus facilitate the control of the oxidizing power by decreasing the initial manganese content of the steel. As a matter of fact, for a steel having the same initial content m% of silicon as above, but an initial manganese content which is reduced to $n_2$%, the adjustment range for the oxidizing power of the reactive cooling medium in accordance with the invention is defined by a range of width $\Delta_2 = y_2 - x$ which is considerably larger than $\Delta_1$ for the adjustment of the dissolved oxygen contents.

Another advantage resulting from the invention is that it decreases the frequency of breaks of the steel wire. This is due to the fact that, in accordance with the invention, only silica is formed at the outlet of the nozzle. This silica adheres to the inner wall and the outlet face of the nozzle.

The work of G. K. Sigworth and J. F. Elliott (The Conditions For Nucleation Of Oxides During The Silicon Deoxydation Of Steel, in Metallurgical Trans. Vol.

4, I/1973, pages 105 to 113), relating to the conditions for homogeneous nucleation of the silica during the deoxidation of silicon steels shows that this necleation requires an oxygen activity in the steel, therefore an oxidizing power of the gas near the steel in an oxidation process such as the one in accordance with the invention, which is much greater than the theoretical activity at the thermodynamic equilibrium.

If, therefore, the cooling medium in the zone adjacent to the orifice of the nozzle is entirely inert, that is to say without oxidizing power, the jet of steel is deprived of silica nuclei. In order then to obtain from this zone the homogeneous nucleation of the silica which is indispensable for the obtaining of a wire, it is necessary to have an oxygen activity which is far higher than the oxygen activity at the thermochemical equilibrium. More unstable conditions of manufacture are then noted.

If, on the other hand, a cooling medium of controlled oxidizing power permits the formation of a thin film of silica in the zone adjacent to the orifice of the nozzle not only on the jet but also by adherence to the nozzle at the point where the jet comes into contact with the cooling medium, the film of silica on the nozzle acts as nucleation initiator for the film of silica on the jet. Thus, although the oxidizing power of the cooling medium — at least in the zone adjacent to the orifice of the nozzle — is maintained, in accordance with the invention, at a level such that any risk of excess oxidation of the steel is avoided, the formation of the film on the jet is more uniform and the jet is more stable.

The frequency of breaks of the wire can be still further decreased, while assuring a satisfactory life for the nozzle, by limiting the use of the reactive cooling medium of the invention to a zone adjacent to the orifice of the nozzle and simultaneously increasing, outside said zone, the oxidizing power of the reactive cooling medium progressively or in successive steps. For this purpose, it is sufficient to add, outside said zone and in at least one suitable place, carbon monoxide and/or carbon dioxide and/or preferably steam to the reactive cooling medium in accordance with the invention.

This is equivalent to creating a stratification of the (increasing) oxidizing power of the reactive cooling medium around the jet of liquid steel advancing in the reactive cooling medium.

Another advantage of operating in accordance with the invention in a reactive cooling medium of controlled oxidizing power and possibly widening the control range of the oxidizing power by limiting the manganese content of the silicon steel used is to facilitate the obtaining and utilization of the means for carrying out this control.

Figure 2:
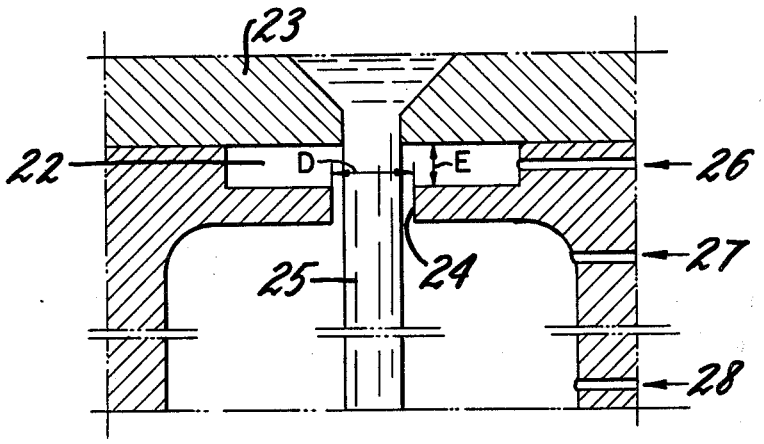
FIG. 2 is a simplified partial elevational view in cross section of an apparatus employing a reactive cooling medium in accordance with the invention.

It is easy, as a matter of fact, to form a zone of controlled oxidizing power, at least at the outlet of the orifice of the nozzle, by creating within the reactive cooling medium a dynamic excess pressure which is localized in said zone and/or by providing (FIG. 2) a chamber 22 adjacent to the orifice of the nozzle 23 and having, for instance, an axial length E and a diameter D of the orifice of passage 24 for the jet 25 on the order of 1 mm for jets of a diameter of 150 to 200 μm. The machining and installing of such a device are inexpensive.

Experience shows that satisfactory results with respect to the life of the nozzles and the continuity of the wire are obtained in the case of carbon steels having manganese contents of less than 0.5% and preferably less than 0.25%.

After 8 hours of operation under the above conditions in accordance with the invention, a nozzle 23 showed no apparent wear of the orifice except for a slight trace of silica glass on the periphery of the orifice.

| | | |
|---|---|---|
| Composition of the steel: | C = 0.4%, | Mn = 0.10% |
| | Si = 3.5%, | Cr = 0.8% |

Diameter of the orifice of the nozzle 23: 165 μm

Speed of projection: 15 m/second

Chamber 22 adjacent to the orifice of the nozzle 23: D = 1.5 mm, E = 2 mm.

Reactive cooling medium:

in the zone 22 adjacent to the orifice of the nozzle 23 a mixture of hydrogen (1 liter/minute) and carbon monoxide (0.5 liter/minute) is introduced at 26;

outside the zone 22 adjacent to the orifice of the nozzle 23, carbon monoxide (0.7 liter/minute) is introduced at the level 27 which is 1.5 cm from the nozzle 23, and steam (0.08 kg/minute) and hydrogen (25 liters/minute) are added at the level 28 which is 40 cm from the nozzle 23.

The same life of the nozzle 23 is obtained by introducing one of the following mixtures into the zone 22 which is adjacent to the orifice of the nozzle 23:

nitrogen (1.6 liters/minute) and carbon monoxide (0.2 liter/minute), hydrogen (1 liter/minute) and steam (8 mg/minute).

Instead of introducing a mixture of hydrogen and carbon monoxide and then steam outside the zone 22 adjacent to the orifice of the nozzle 23, one may introduce therein only a mixture of hydrogen (25 liters/minute) and carbon dioxide (0.6 liter/minute).

What is claimed is:

1. In a process for the manufacture of wire by projecting a jet of liquid steel which contains silicon and manganese through a nozzle into a cooling enclosure containing a reactive cooling medium which is a gaseous mixture having an oxidizing power with respect to the steel, the improvement which comprises controlling and limiting the oxidizing power of the reactive cooling medium by providing a gaseous mixture of an inert gas and/or a reducing gas with a gas which is an oxidant with respect to the steel, at least in the zone adjacent to the orifice of the nozzle, so as to prevent the formation of iron and manganese oxides and/or silicates and permit the formation of silica alone at the thermochemical equilibrium corresponding to the temperature prevailing near the orifice of the nozzle.

2. The process as defined by claim 1, wherein the reactive cooling medium is subjected to a dynamic excess pressure in the zone adjacent to the orifice of the nozzle.

3. The process as defined by claim 2, wherein the reactive cooling medium is subjected to the dynamic excess pressure within a chamber adjacent to the orifice of the nozzle and having a passage orifice for the jet.

4. The process as defined by claim 1, wherein the gaseous mixture is a mixture of helium and carbon monoxide.

5. The process as defined by claim 1, wherein the gaseous mixture is a mixture of hydrogen and carbon monoxide.

6. The process as defined by claim 1, wherein the gaseous mixture is a mixture of nitrogen and carbon monoxide.

7. The process as defined by claim 1, wherein the gaseous mixture is a mixture of hydrogen and steam.

8. The process as defined by claim 1, wherein the oxidizing power of the reactive cooling medium is higher outside the zone adjacent to the orifice of the nozzle than that prevailing in the zone adjacent to the orifice of the nozzle.

9. The process as defined by claim 8, wherein the oxidizing power of the reactive cooling medium is increased progressively or stepwise by adding carbon monoxide and/or carbon dioxide and/or steam to the reactive cooling medium outside said adjacent zone.

10. The process as defined by claim 1, wherein the liquid steel is a carbon steel containing silicon and manganese, the manganese content being at most equal to 0.50% by weight of the carbon steel.

11. The process as defined by claim 10, wherein the carbon steel has a manganese content at most equal to 0.25% by weight of the carbon steel.

* * * * *